US010645982B2

(12) United States Patent
Bayer

(10) Patent No.: US 10,645,982 B2
(45) Date of Patent: May 12, 2020

(54) PROTECTIVE ATHLETIC HELMET TO REDUCE LINEAR AND ROTATIONAL BRAIN ACCELERATION

(71) Applicant: Robert T. Bayer, Asheville, NC (US)

(72) Inventor: Robert T. Bayer, Asheville, NC (US)

( * ) Notice: Subject to any disclaimer, the term of this patent is extended or adjusted under 35 U.S.C. 154(b) by 1101 days.

(21) Appl. No.: 14/504,670

(22) Filed: Oct. 2, 2014

(65) Prior Publication Data

US 2015/0113718 A1 Apr. 30, 2015

Related U.S. Application Data

(60) Provisional application No. 61/961,968, filed on Oct. 28, 2013, provisional application No. 61/995,829, filed on Apr. 21, 2014.

(51) Int. Cl.

| | |
|---|---|
| ***A41D 13/05*** | (2006.01) |
| ***A42B 3/14*** | (2006.01) |
| ***A42B 3/04*** | (2006.01) |
| ***A42B 3/06*** | (2006.01) |

(52) U.S. Cl.

CPC ..... *A41D 13/0512* (2013.01); *A42B 3/0473* (2013.01); *A42B 3/064* (2013.01); *A42B 3/14* (2013.01)

(58) Field of Classification Search

CPC ..... A42B 3/0473; A42B 3/00

See application file for complete search history.

(56) References Cited

U.S. PATENT DOCUMENTS

| | | | | | |
|---|---|---|---|---|---|
| 1,698,769 | A | * | 1/1929 | Mullins | A42B 3/00 2/425 |
| 1,977,215 | A | * | 10/1934 | Strauss | A42B 3/06 2/412 |
| 2,793,365 | A | * | 5/1957 | Kleinman | A42B 3/06 2/413 |
| 2,793,366 | A | * | 5/1957 | Kleinman | A42B 3/22 2/411 |
| 2,878,478 | A | * | 3/1959 | Kleinman | A42B 3/10 2/414 |
| 3,186,004 | A | | 6/1965 | Carlini | |
| 3,292,180 | A | * | 12/1966 | Marietta | A42B 3/12 2/415 |
| 4,290,149 | A | * | 9/1981 | Aileo | A42C 2/007 2/414 |
| 4,404,690 | A | | 9/1983 | Farquharson | |

(Continued)

*Primary Examiner* — Alissa J Tompkins
*Assistant Examiner* — Brieanna Szafran
(74) *Attorney, Agent, or Firm* — William G. Heedy; The Van Winkle Law Firm

(57) ABSTRACT

A protective helmet is provided having an upper section and a lower section, each having an inside and an outside surface. A gap is formed between the upper section and the lower section. Resilient members in the form of a plurality of spaced apart compression struts are provided for connecting the upper section to the lower section. The upper section is movable with respect to the lower section whereby a portion of the force of an impact to the upper section will be absorbed and will not be transmitted to the lower section. A suspension harness is attached to the inside surface of the lower section. The suspension harness is adapted to receive a portion of the helmet user's head and to keep the helmet user's head from contacting the inside surface of the upper section.

37 Claims, 6 Drawing Sheets

(56) References Cited

U.S. PATENT DOCUMENTS

| | | | | |
|---|---|---|---|---|
| 5,204,998 | A * | 4/1993 | Liu | F16F 1/3732 2/411 |
| 5,713,082 | A | 2/1998 | Bassette et al. | |
| 6,025,067 | A * | 2/2000 | Fay | B32B 27/08 428/314.4 |
| 6,446,270 | B1 | 9/2002 | Durr | |
| 8,850,622 | B2 * | 10/2014 | Finiel | A42B 3/125 2/410 |
| 2004/0064873 | A1 * | 4/2004 | Muskovitz | A42B 3/283 2/410 |
| 2005/0273911 | A1 * | 12/2005 | Skiba | A42B 3/063 2/412 |
| 2006/0059606 | A1 * | 3/2006 | Ferrara | A01N 25/18 2/412 |
| 2010/0088807 | A1 * | 4/2010 | Jeong | A42B 3/062 2/410 |
| 2013/0061371 | A1 * | 3/2013 | Phipps | A42B 3/064 2/411 |

* cited by examiner

PROTECTIVE ATHLETIC HELMET TO REDUCE LINEAR AND ROTATIONAL BRAIN ACCELERATION

RELATIONSHIP TO PRIOR APPLICATION

This is a U.S. non-provisional application relating to and claiming the benefit of U.S. Provisional Patent Application Ser. No. 61/961,968 filed Oct. 28, 2013 and U.S. Provisional Patent Application Ser. No. 61/995,829 filed Apr. 21, 2014.

BACKGROUND

This invention relates to protective helmets, in particular, protective helmets used in sporting events. More particularly, this invention relates to football helmets.

It is estimated that there are currently five million football players in the U.S. (200,000 professional, 100,000 college, 1.3 million high school, and 3.5 million youth players). In recent years, it has become quite clear that the most popular sport in America is actually quite dangerous. Estimates vary, but several studies suggest that up to fifteen percent of football players suffer at least a mild traumatic brain injury (MTBI) each season.

For decades, football players and other athletes have grappled with the effects, years later, of head injuries, including memory loss, moods swings, irritability, difficulty walking, and depression. These symptoms are potential indications of chronic traumatic encephalopathy, a degenerative disease found in the brains of athletes who have sustained blows to the head.

For professional football, it has been found that there is an average of 1.5 to 2.0 concussions each game. The chances for a concussion or other injuries, such as a neck injury, are exacerbated during helmet-to-helmet contact. In high school football in recent years, there are approximately 67,000 diagnosed concussions every year. Additionally, many undiagnosed and unreported concussions are experienced. Experts in the field contend that linear and particularly rotational acceleration of the brain caused by on-field impacts is a major factor leading to MTBI and concussions. While many existing helmets help to attenuate linear acceleration, it is believed that none realistically address reduction of rotational acceleration caused by oblique or angular impacts. Thus, there is a need for safer helmets, particularly football helmets, which reduce the risk of injury to the user and to the other players. This invention is also applicable to other activities in which participants use helmets, such as soccer, lacrosse, hockey, boxing, cycling, skiing, wrestling, auto racing, and military.

In May 2013, the Biomedical Engineering Society published a peer-reviewed research report from Virginia Tech that was sponsored by the National Institutes of Health. The report concluded that a helmet that lowers head acceleration predicts lower incidence of concussion, and that helmets which better manage impact energies result in lower head accelerations and thus a lower risk of head injury.

OBJECTS OF THE INVENTION

It is one object of this invention to provide an improved athletic helmet to help in reducing the risk of concussions, mild traumatic brain injuries (MTBI), and other head injuries.

It is another object of this invention to provide an improved athletic helmet to reduce the effects of both linear and rotational acceleration of the brain upon impact, since lowering head acceleration lowers the risk of concussion.

It is another object of this invention to provide a helmet which offers rotational acceleration protection in addition to meeting or exceeding the current NOCSAE (National Operating Committee on Standards for Athletic Equipment) linear acceleration certification specifications and is light weight, has a soft outer surface, and has a smaller profile than current helmets.

SUMMARY OF THE INVENTION

In accordance with one form of this invention there is provided a protective helmet having an upper section and a lower section. A gap is formed between the upper section and the lower section. At least one resilient member connects the upper section to the lower section. The upper section is movable with respect to the lower section so that a portion of the force from an impact to the upper section will be absorbed and will not be transmitted to the lower section.

In accordance with another form of this invention there is provided a protective helmet having an upper section and a lower section. Each section has an inside surface and an outside surface. A gap is formed between the upper section and the lower section. At least one connection member connects the upper section to the lower section and maintains the gap. The upper section is movable with respect to the lower section when an impact force is applied to the outside surface of the upper section. A suspension harness is attached to the inside surface of the lower section. The suspension harness is adapted to receive a portion of the helmet user's head.

In accordance with yet another form of this invention there is provided a protective helmet including an upper section and a lower section. A gap is formed between the upper section and the lower section. At least one resilient member connects the upper section to the lower section. The upper section is movable with respect to the lower section so that a portion of the force from an impact to the upper section will be absorbed and will not be transmitted to the lower section. A suspension harness is attached to the inside surface of the lower section. The harness is adapted to receive a portion of the helmet user's head. The resilient member includes a plurality of spaced apart compression struts. The struts have a top portion and a bottom portion. The top portion of each strut is connected to the upper section and the bottom portion of each strut is connected to the lower section. The struts are formed so as to be able to compress, flex and rotate so as to absorb an amount of energy from an impact to the upper section. The struts are curved thereby having a convex side and a concave side. The upper and lower sections each have an inside surface and an outside surface. A portion of the concave sides of the struts face the inside surfaces of the upper and lower sections.

DESCRIPTION OF THE PREFERRED EMBODIMENTS OF THE INVENTION

Figure 1A:
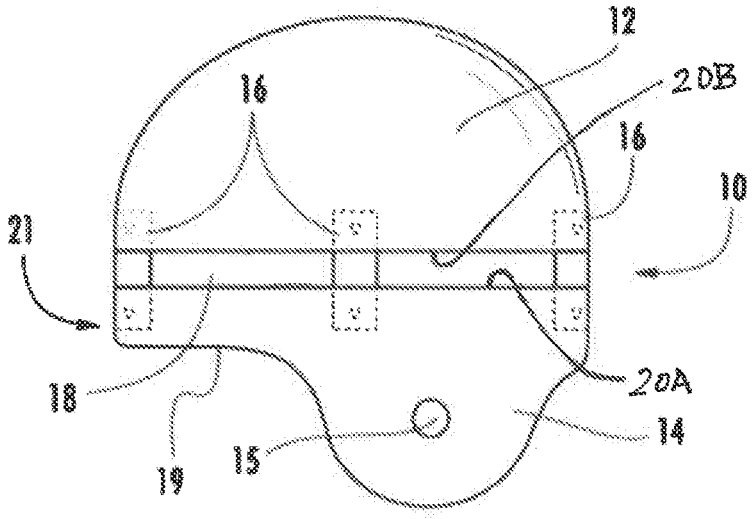
FIG. 1A is a side view of the embodiment of FIG. 1.
Figure 1:
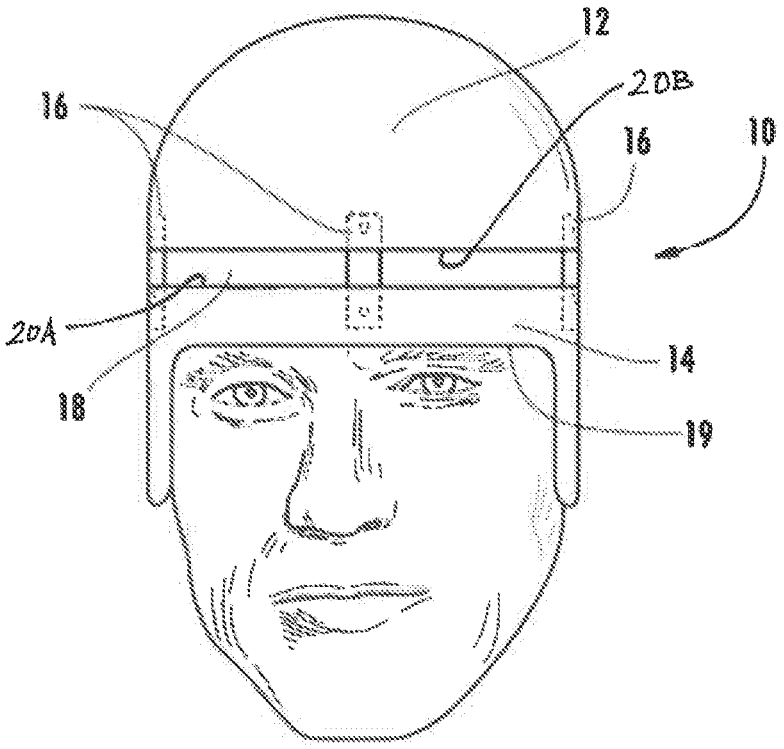
FIG. 1 is a frontal view showing one of the preferred embodiments of the invention; for illustration purposes, the face guard, chinstrap, and jaw pads are not shown.

Referring now more particularly to FIGS. 1 and 1A, there is provided helmet 10 having pliant upper soft-shell section 12 and lower hard-shell section 14. This is a two-piece helmet whereby upper section 12 can move independently of lower section 14 with the wearer's head being securely anchored to and inside lower section 14.

The wearer's head thus will extend upward into airspace 11 surrounded by the inside surface 13 of the upper portion 12. Upon impact to upper section 12, a reduced amount of energy is transmitted to the head since the head is "floating" in the air space. Unlike conventional helmets, the head does not contact upper section 12.

To allow the helmet 10 to absorb more of the energy of an impact, there is the need to extend the duration of the impact motion by having helmet upper section 12 that inwardly flexes, and then slowly restores itself. The longer it takes for the helmet shell to bend, the more energy it absorbs. The result is less energy being transferred to the wearer's head and brain. In order to reduce linear and rotational acceleration of the brain, upper section 12 offers impact protection in two ways. The entire upper section 12 itself will move due to the nature of struts 16, which are discussed below, upon impact. Also, the pliable "semi-soft" surface of upper section 12 will flex inwardly upon impact. Both actions serve to absorb energy and attenuate dramatic motion of the head, with a resultant decrease in linear and rotational brain acceleration.

Upper section 12 preferably is made from semi-flexible polyethylene or polyurethane foam with a urethane coating on the outer surface. It is preferred that upper section have conventional ventilation holes (not shown). The lower section 14 preferably is made from polycarbonate alloy (PCA) or acrylonitrile butadiene styrene plastic (ABS) by injection molding. Lower section 14 has conventional earhole openings 15 and is of conventional shape, approximately 3/16 inch thick. There is a spacing gap 18 between upper section 12 and lower section 14 preferably approximately ½ inch, such that an upper perimeter rim 20A of the lower section 14 is vertically spaced apart from a lower perimeter rim 20B of the upper section 12. Therefore, the entire lower perimeter rim of the upper section is vertically spaced above the entire upper perimeter rim of the lower section. The bottom of the gap is preferably positioned approximately 1½ inches above the lowest edge 19 of the front 21 of lower section 14 and continues horizontally around the periphery of the lower section 14. Compression struts 16 attach to upper section 12 and lower section 14 preferably with bolts and are positioned to provide the ½ inch spacing of gap 18. Preferably there are four compression struts 16. In addition to their flexing action, the struts 16 serve to connect upper section 12 and lower section 14.

Figure 2:
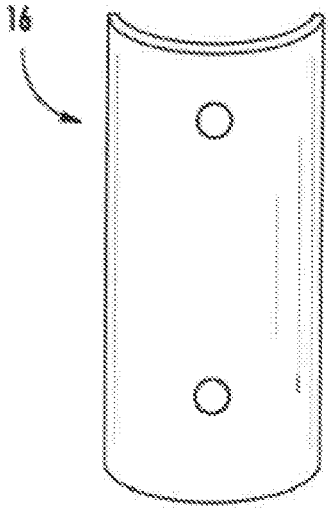
FIG. 2 is a frontal view of a compression strut shown in FIG. 1.
Figure 2A:
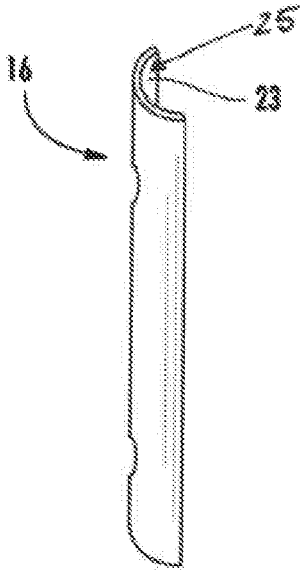
FIG. 2A is a side view of the compression strut shown in FIG. 2.

FIGS. 2 and 2A show one of the plastic compression struts 16. Struts 16 are preferably located at the front, rear, and both sides of helmet 10. Due to the ½ inch spacing of gap 18 between upper section 12 and lower section 14 of the helmet 10, the compression struts 16 can compress, flex, and slightly rotate in any direction, so that some of the impact energy will be absorbed and thus reduce the harmful effects to the head during an impact on the upper section 12 of helmet 10. The absorption of this impact energy occurs because of the movement of upper section 12 and the resilient nature of compression struts 16. This reduces the linear and rotational acceleration of the brain. Since the head harness 20, described below, is attached to lower section 14, forced movement of upper section 12 is not directly transmitted to the head, which is firmly held in place inside lower section 14. Upper section 12 will move slightly in any direction upon impact, but will return to its normal position due to the flexing nature of struts 16. The struts 16 preferably limit the movement of upper section 12 to approximately ½ inch in any direction.

In the embodiment of FIGS. 1 and 1A, there are four compression struts 16. Preferably the struts 16 are fabricated from hollow tubing of plastic or rubber so as to retain their curvature when they are cut into curved pieces preferably 1¼ inches wide by 1¾ inches high as shown in FIGS. 2 and 2A. The struts 16 are mounted to upper section 12 and lower section 14 with at least a portion 25 of the concave side 23 of strut 16 facing the inside surfaces of the upper section 12 and lower section 14 of helmet 10. The curvature retention and the concave mounting add to the ability of the struts 16 to flex and return to their original position. Before cutting a tube to form the struts 16, the outside diameter of the hollow tubes is preferably between ¾ inch and 1½ inches, the inside diameter is preferably between ½ inch and ¾ inches, and the wall thickness is preferably between 1/16 inch and ¼ inch thick. Also preferably, the Durometer hardness of the material from which the compression struts 16 are made is between 40A and 75A, the tensile strength is between 1800 psi and 2700 psi, and the bend radius is between 1.25 inches and 4 inches. Preferably the compression struts 16 are made from tubular polyvinyl chloride. An example of an appropriate tube is commercially available from McMaster-Carr Supply Company as part #5894K41. The compression struts 16 may be customized for all groups of users. For example, youth helmets may have a softer flex than professional helmets to offer added protection. Alternatively, the struts 16 may be made from flat plastic or rubber stock.

Upper section 12 may be formed by thermoforming, casting or by injection molding, or a similar process, a semi-flexible polyurethane or cross-linked polyethylene foam to the proper shape. The contour of the upper section 12 outer surface may be rounded more than traditional helmets so as to promote the deflection of a blow by an opponent's helmet or other surface. With less "flat" surfaces and a more sloped surface area, the striking helmet can more easily "slide off" the subject helmet, and vice versa, thus reducing the energy of the impact. Preferably the foam for upper section 12 is approximately ⅜ inch to ½ inch thick with a density of 4-6 pounds per cubic foot. Other foam materials may be utilized such as TPU, TPR, EPS, LDPE, HDPE, or similar, as well as leather and leather/foam laminates. To impart surface resistance to impact and abrasion, the outer surface of shaped foam upper section 12 may be coated with a polyurethane polyurea hard coating, or a similar coating such as thixotronic plastics. However, the resulting structure should have the ability to inwardly flex and return to its original shape. Four coats are equivalent to approximately 3 mils thickness, which is the preferred thickness. A suitable polyurethane polyurea coating is commercially available from Industrial Polymers of Houston, Tex.

Figure 3:
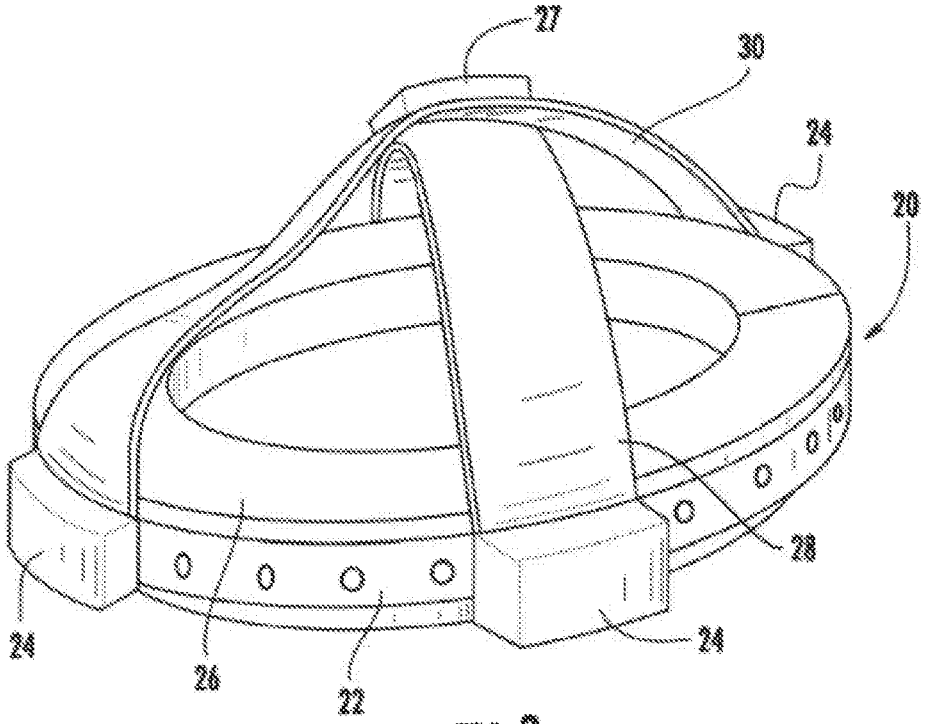
FIG. 3 is a perspective vie of a suspension head harness before insertion in the helmet of FIG. 1.

FIG. 3 shows suspension head harness 20 which includes a curved plastic band 22. Head harness 20 further includes foam ring 26 received on the inside of band 22. The circumference of band 22 and ring 26 are selected to fit an individual user's head. The foam ring 26 will be described in more detail below. Plastic band 22 is preferably made from polypropylene, ¾ inch wide. Two similar commercially available bands 22 are Lowes item #30246 and Ace Hardware item #554-25.

Head harness 20 further includes a pair of crossed 1½ inches wide head straps 28 and 30 that rest against the top of the user's head. Head straps 28 and 30 limit how far the user's head can extend upward into upper section 12. Preferably the straps are made from nylon or polypropylene webbing. A suitable strap material is commercially available from Tennessee Webbing as item # WP1001-2.

Figure 4:
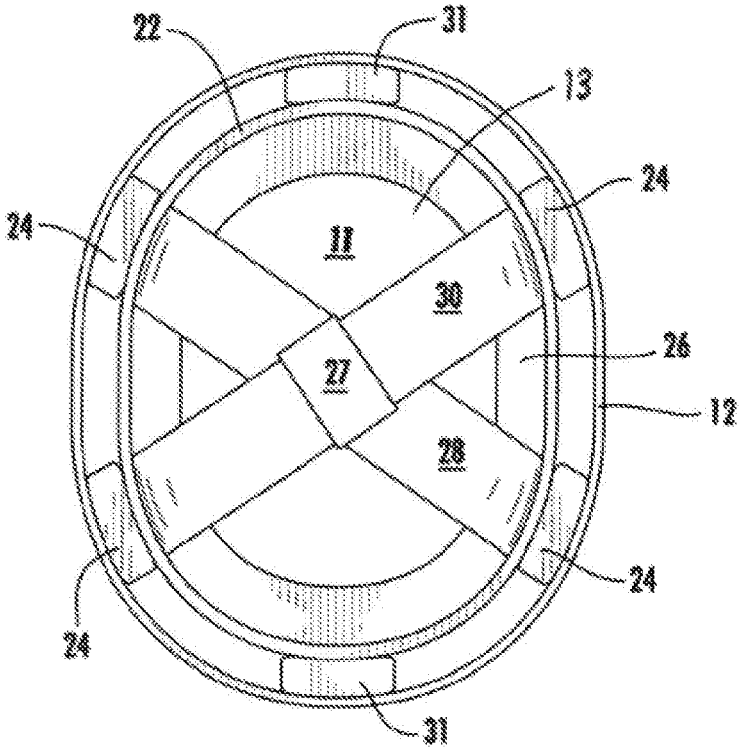
FIG. 4 is a top view of the suspension harness of FIG. 3 received in the lower section of the helmet of FIG. 1 with the upper section having been removed.

FIG. 4 shows a top view of lower section 14 as viewed from above. Head harness 20 is mounted inside lower section 14. For illustrative purposes, upper section 12 is not shown in FIG. 4. Foam pad 27, approximately 2 inches by 1 inch by ¼ inch thick, may be affixed to the upper surface of strap 28 where it crosses strap 30. This pad offers additional protection against the top of the wearer's head from hitting the top inside surface of upper section 12 during a severe impact.

The positioning of head harness 20 inside the lower section 14, and the elimination of conventional interior padding, results in airspace between the user's head and the inside top and inside side surfaces of upper section 12. This airspace provides space for the compression struts 16 to flex laterally, inwardly, and downwardly during an impact so that upper section 12 may move without touching the wearer's head. Head harness 20 is secured to lower section 14 by tee-bolts or "one-way" snaps.

Ring 26 is made from foam and may be attached to plastic band 22 using screws, snaps, hook and loop fasteners, or glue. Four foam spacers 24 are attached to the outer surface of band 22 and serve to offset the head harness 20 from the inner surfaces of the lower section 14. The spacers 24 are positioned in the center of the four quadrants of band 22 and are approximately 2 inches by 1 inch by 1 inch thick. The spacers 24 further add to the impact-absorbing features of the helmet. Foam pads 31 are attached by glue at the inside center front and rear of lower section 14 to offer additional energy absorption upon impact. These two pads 31 are mounted so as to be opposite to ring 26 at approximately the same height.

Bolts may be positioned through the thickness of spacers 24 from the inside to the outside of the pad, and through drilled holes in lower section 14. The bolts are fastened with tee-nuts that, after tightening, are flush to the outside surface of lower section 14. Head straps 28 and 30 may also be attached with the same bolts used to attach the spacers 24, by affixing the ends of the head straps 28 and 30 in between band 22 and foam ring 26. Since the four spacers 24 are attached to band 22, the entire head harness assembly 20 is thereby affixed to the inner surfaces of lower section 14. Acceptable foams for ring 26 are foams C-40, C-42, C-45 and C-47 commercially available from 3M Company's Confor, Durafoam from Monmouth Rubber and Plastics Corp., Poron XRD Foam from Rogers Corp., SunMate Firm and X Firm from Dynamic Systems. Inc. These foams are "slow spring-back" foams. A slow return to the foam's normal position after impact means that there is less dramatic rebound and more energy absorption.

Size adjustability of head harness suspension 20 is accomplished by using replaceable pieces of foam ring 26 having varying thicknesses and degrees of firmness. To aid in this replacement feature, the foam 26 may be attached to band 22 with Velcro, Dual Lock from 3M, or other hook and loop fasteners, or with one-way snaps. The length of head straps 28 and 30 may also be adjusted for varying head sizes.

The compression struts 16 and foam rings 26 and pads 24 and 31 may be treated with an anti-microbial material to reduce the transmission of disease and inhibit odor and the growth of mold and mildew. An example is Microban, commercially available from Microban Company. The foam pad 26 may also be covered with an absorbent material to absorb perspiration. Suitable absorbent materials include common nonwoven, woven, or knit materials.

Figure 5:
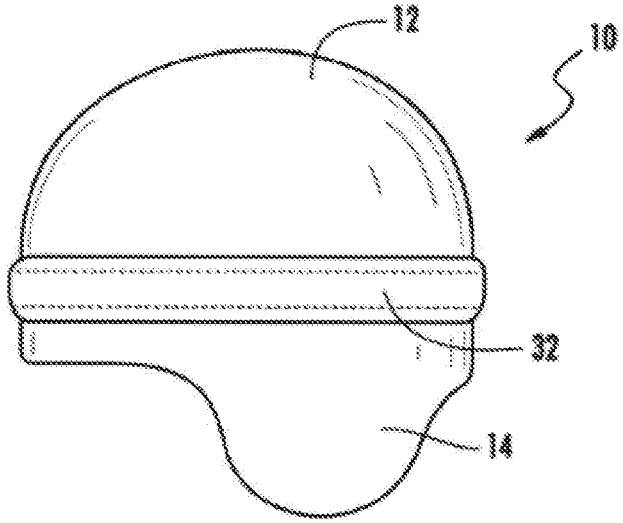
FIG. 5 is a side view of the embodiment of FIG. 1 with a stretchable band covering the gap between the upper and lower sections of the helmet.

FIG. 5 shows helmet 10 with a 7/16 inch to 2 inches wide stretchable band 32 or flexible gasket, around the periphery to cover the ½ inch air space 18 and to keep out debris. The stretchability will further permit the upper section 12 to move independently from lower section 14 upon impact. The band may be attached to upper section 12 and lower section 14 by intermittent lines of adhesive. Examples of suitable materials for band 32 are commercially available from McMaster-Carr as item #8825K68 1 inch poly elastic or Ace Hardware 51270 Vinyl Gasket. The band 32 may also be customized in terms of size and material. For example, band 32 may consist of an EPDM foam rubber "bulb seal" gasket. Attached to the outside lower edge of upper section 12, the "bulb" may extend outwardly approximately ½ to ¾ inch and the flap section of the gasket would extend downwardly to cover gap 18. An example of a commercially available gasket is McMaster-Carr's part #93085K91.

If added stiffness is needed for higher levels of football participation, additional struts 16 may be utilized beyond the four shown. For example, sir or eight struts may be used, and stiffer struts may be utilized.

There may be mechanisms for attaching a conventional faceguard (not shown) to lower section 14 with bolts on each side of the faceguard. To attenuate energy and to action as a shock absorber, the bolt connectors may include thick compressible washers (not shown) made from foam, rubber, fiber, plastic or similar. The washers may be ¼ inch to ½ inch in thickness and placed between the outer surface of lower section 14 and the inner surface of the faceguard attachment area. To further absorb impact energy, the faceguard may be attached at its side to lower section 14 and not at the top of the faceguard as in conventional constructions. Thus, an impact to the facemask will not be transmitted to upper section 12 and the upper section 12 will be able to rotate/flex without regard to the facemask. The faceguard may also be formed from any material suitable to function as a football helmet faceguard, as is known in the art. Plastic covered metal or plastic are two examples of suitable materials. The faceguard may also be constructed of titanium, for example, to reduce its weight from a typical 1.2 pounds to 0.55 pound. Other lightweight and more compressible materials may also be utilized.

An adjustable chinstrap (not shown) may be attached to the outer surface of lower section 14. The chinstrap may be of conventional design with a chin cup, as is known in the art. Preferably, the chinstrap will contain two straps on each side and will be releasably secured to four outside locations of lower section 14 by male and female snap connectors.

Two jaw pads (not shown), one on each side, may be attached to the inner surface of lower section 14. The pads may be of conventional design and made from resilient material, as is know in the art. Each pad will be preferably connected at three points with lower section 14, preferably with male and female snaps or hook and loop fasteners. This will result in easy insertion and removal for size adjustability.

Helmet 10 has been designed to reduce the overall weight and profile to further attenuate the risk of MTBI and concussion. The preferred embodiment with a soft top would be especially suitable for youth football players, ages 5-13, for several reasons. It is lighter weight and has a smaller profile than conventional helmets. Since the helmet flexes and is "soft" it cannot be used as a "dangerous weapon" against another player, even accidentally. The reduction of weight and profile will help to attenuate the impact forces transmitted to the brain. As an example, the size large youth helmet of the subject invention should weigh approximately 2.70 pounds, compared to 3.80 to 4.20 pounds for leading commercially available large youth helmets. This is a 29 to 36 percent reduction. For a nine year-old football player, this reduces the helmet mass as a percentage of head mass from about 41 percent down to 31 percent, which is critical to the development of young brains. The profile of helmet 10 may be reduced since the subject design does not need to accommodate the thicknesses of foam pads as found in the tops and side of conventional helmets. As part of the smaller profile, the contour of helmet upper section 12 may be more rounded as discussed above. The utilization of a "soft top" design should be considered in the context of all players wearing a similar "soft" helmet.

The National Operating Committee on Standards for Athletic Equipment (NOCSAE) is the governing body for certification of football helmets. However, the NOCSAE "Drop Test" measures only linear brain acceleration. Measured is the Severity Index (SI) which rates the protectiveness of a helmet based on the risk of severe skull fracture and the peak linear acceleration measured in Gs. Thus, current certified helmets do a good job of attenuating linear acceleration, which in turn limits catastrophic head injuries such as skull fracture, lacerations, etc. However, research indicates that high values of rotational or angular acceleration of the brain also plays a major role, if not being the major factor, in causing MTBI and concussions.

Initial prototypes of helmet 10 (both the soft top, and the hard top version discussed below) were sent to a leading bioengineering laboratory for impact testing. Both subject helmets and a commercially available "control" helmet were subjected to the Linear Impactor Test, which measures both linear and rotational acceleration of the brain at various locations on the helmet. This is a more stringent test than the required NOCSAE Drop Test since the hybrid dummy headform, on which the test helmets are mounted, includes a neck-spring component.

Three criteria were used to evaluate the severity of each impact: Head Injury Criteria (HIC), Severity Index (SI), and Peak Angular Acceleration. From the results, values were calculated to correlate these indices to the risk of severe brain injury and to the risk of MTBI or concussion.

Initial prototypes of helmet 10 easily surpassed the NOCSAE certification standards for linear acceleration and were comparable to the control helmet. The tests on these helmets 10 and subsequent calculations also indicated that the risks of severe brain injury, MTBI, and concussion were extremely low. Moreover, the subject helmets surpassed the control helmet in lowering rotational acceleration, which is felt to be a major predictor of concussion and other head injuries. As an example, Peak Angular Acceleration of the headform for a rear impact was 1787 rad/s2 for soft top 10, as compared to 2785 rad/s2 for the control helmet. In these tests, the soft top upper section 12 outperformed the hard top upper section 12 in reducing the peak rotational acceleration values.

An alternative embodiment utilizes a "hard top" for upper section 12. The hard top can utilize the same polycarbonate alloy or acrylonitrile butadiene styrene plastic as lower section 14 and is approximately 3/16 inch thick. The rest of helmet 10 is identical to that described above except that the two struts 16 on the sides of helmet 10 would be constructed from a firmer plastic, such as #5233K71 from McMaster-Carr. The hard top embodiment would be suitable for older high school, collegiate and professional players. As mentioned above, this embodiment may also contain more than four struts and may utilize stiffer struts. The side struts 16 may differ from the front and rear struts in composition/flex. Test results discussed above show that this hard top version of helmet 10 exceeded the NOCSAE certification standards and reduced rotational acceleration compared to the control helmet. Calculations by the testing laboratory showed an extremely low risk of severe brain injury, MTBI, and concussion. Alternatively, to reduce weight and improve strength, a combination of Kevlar (aromatic polyamide) and carbon fibers may be used to mold the helmet 10.

Figure 6A:
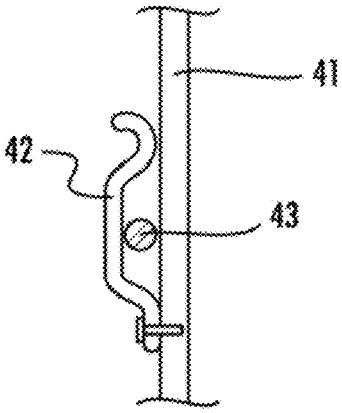
FIG. 6A is a side view of one of the attachment clips of FIG. 6.
Figure 6:
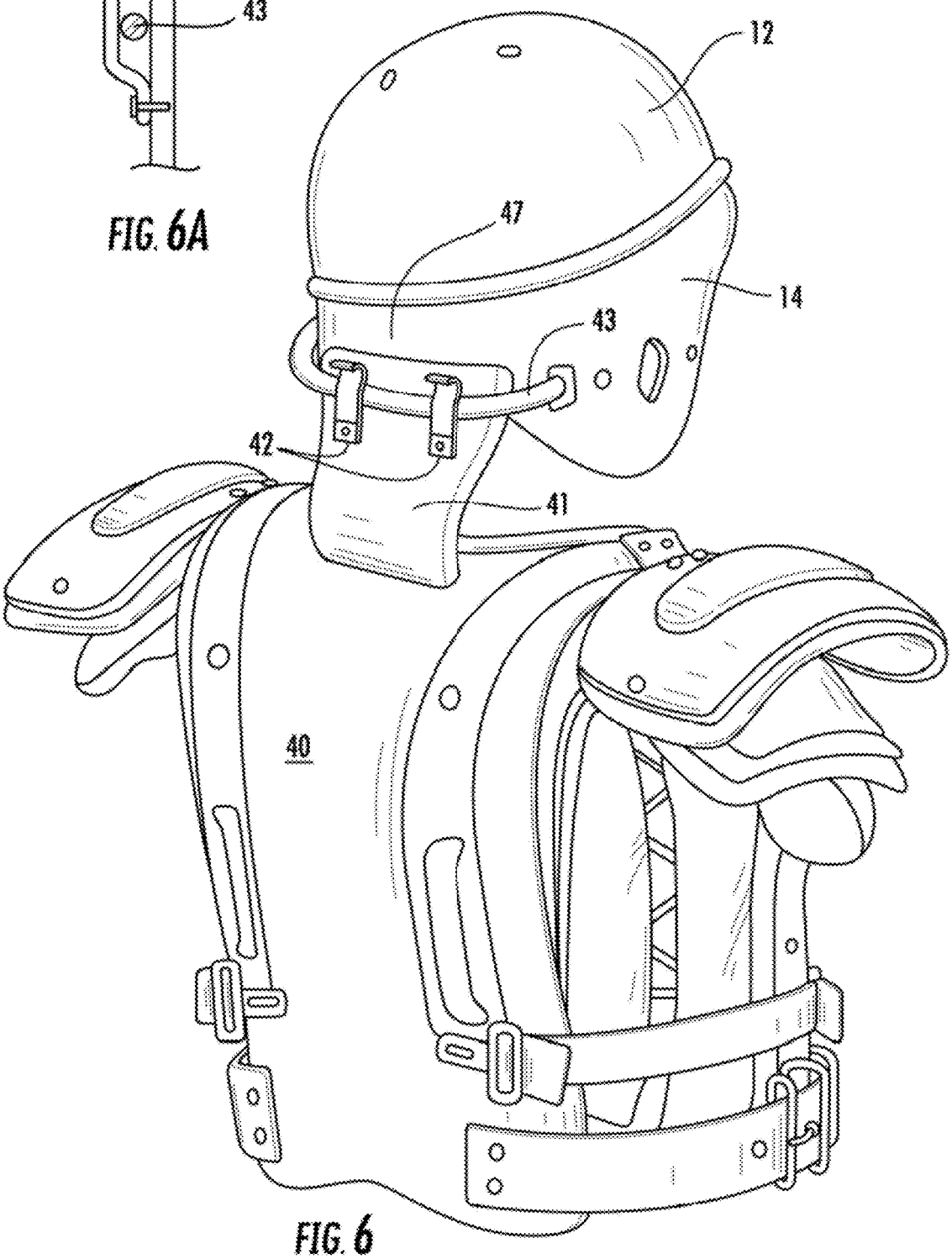
FIG. 6 shows an alternative embodiment of the invention whereby the helmet of FIG. 1 is removably attached to a shoulder pad.

FIGS. 6 and 6A show an alternative embodiment. Helmet 10 is releasably attached to the wearer's shoulder pads 40 to stabilize the neck of the user. This attachment would serve to take a portion of the helmet weight off the neck and protect the head from dramatically whipping forward or whipping sideways. Contoured plastic rod 43, of approximate ½ inch circular diameter, is attached by bolts to the outside rear portion 47 of lower section 14 leaving a space between rod 43 and the outside surface of lower section 14 of preferably approximately 1 inch. Plastic plate 41 is permanently affixed to shoulder pad 40 by bolts and slips into the space between the rod 43 and lower section 14 when the donned helmet 10 is lowered into place on the user's head. Two brackets 42 are affixed to plate 41. The brackets 42 are designed to easily accept rod 43 when the helmet 10 is pushed down onto plate 41. The brackets 42 partially spring closed after rod 43 is pushed down, but allow the helmet to be easily removed by the wearer by pulling up on the helmet to release it from plate 41. There is sufficient spacing between each bracket 42 and the outer surface of plate 41, of approximately 5/8 inch, to permit an up or down movement by rod 43 of approximately 3 to 5 inches vertically. Thus, vertical motion of the head is limited to approximately 5 inches. Further, the width of plate 41 is such that horizontal movement is allowed within the space between rod 43 and lower section 14. The length of rod 43 serves to limit horizontal head movement to about 4 to 6 inches in either direction. This connection will permit the wearer to comfortably move his head vertically and horizontally, but within safe limits. The rod, brackets and plate may be formed may be formed from a durable, low-friction plastic, which permits an easy sliding motion. An example of an appropriate plastic is Delrin made by DuPont. This embodiment may be more relevant to defensive linemen and linebackers to help reduce the risk of brachial plexus injury.

Figure 7:
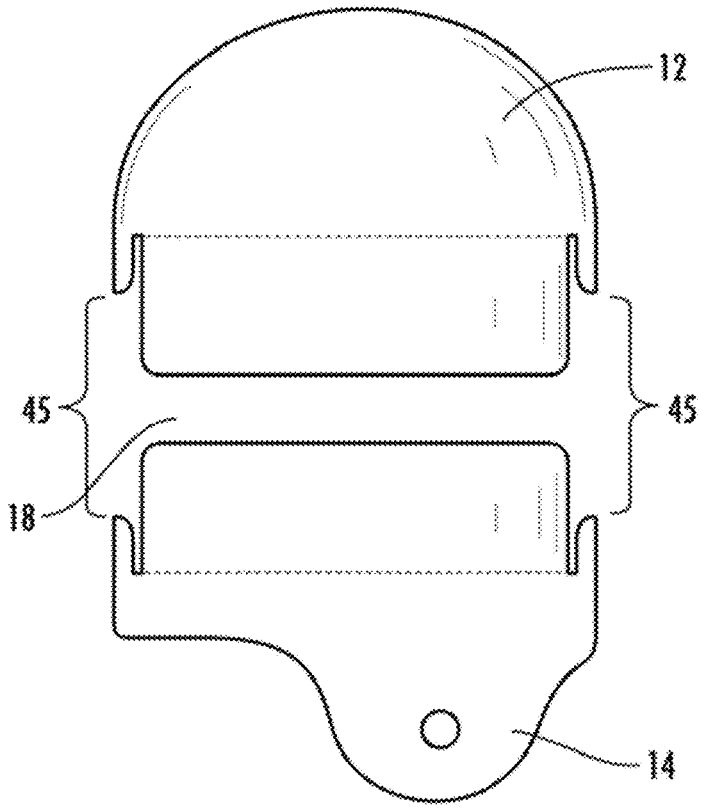
FIGS. 7 and 7A show an alternative embodiment of the invention with the addition of a sliding horizontal continuous band attached to a modified version of the upper and lower sections of the helmet of FIG. 1.
Figure 7A:
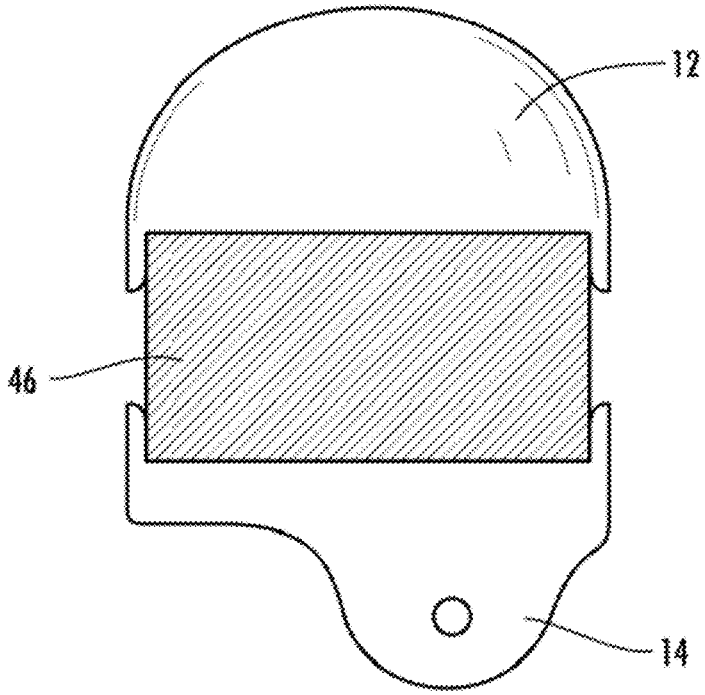

FIGS. 7 and 7A show another embodiment to further aid in the attenuation of rotary acceleration of the brain. Helmet 10 additionally contains slide band 46. The purpose of the slide band is to move laterally in either direction upon an angular impact, thus absorbing a portion of the energy. The slide band covers gap 18 and straddles the outside bottom of upper section 12 and outside top of lower section 14 of the helmet 10 and can move horizontally in either direction upon impact. The slide band may encompass the entire horizontal periphery of the helmet. The slide band is preferably 3 inches in height, but can range from 2½ inches to 5 inches. It is a continuous band and it is positioned on the outer surface of the helmet with fifty percent above gap 18 and fifty percent below. It is designed to run in recessed tracks 45 on the outside of the helmet 10, both in the upper section 12 and in the lower section 14. It is recessed to the depth whereby the outer surface of the band will be flush with the outer surfaces of upper section 12 and lower section 14. This embodiment may also include gap filler 32.

The band 46 may be constructed from a durable, puncture-resistant, weather-resistant, think flexible material and one that will easily slide in tracks 45. Examples include polypropylene or other plastics, or a thin layer of foam, webbing, or rubber, or combinations thereof. The band 46 will have an inner surface that will easily slide in tracks 45. Band 46 may be built into both the soft top and hard top version of helmet 10.

Figure 8:
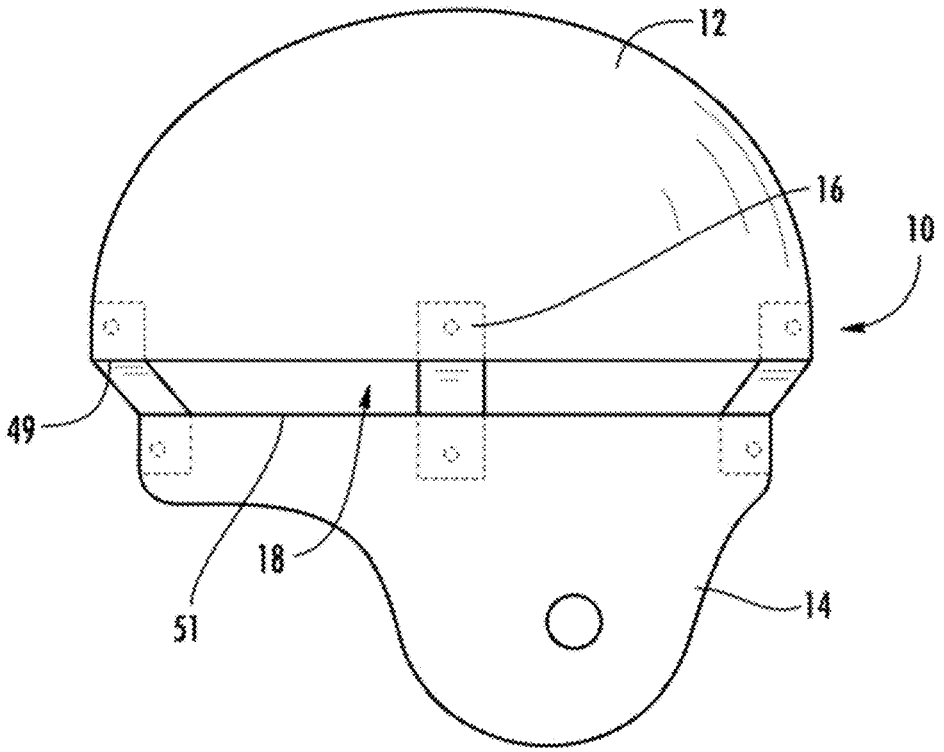
FIG. 8 is an alternative embodiment of the invention whereby the circumference of the periphery of the outer edge of the upper section of the helmet of FIG. 1 is greater than the circumference of the periphery of the outer edge of the lower section.

FIG. 8 shows yet another alternative embodiment of the present invention. In the embodiment of FIG. 8, the circumference of the periphery 49 of the lower edge of upper section 12 of helmet 10 is slightly larger than the circumference of the upper edge of the periphery 51 of lower section 14. Preferably, the major and minor diameters of the periphery 49 of upper section 12 are approximately 1 to 2 inches larger than the major and minor diameters of the upper edge 51 of lower section 14 so that the lower edge of the periphery 49 of upper section 12 overhangs the upper edge 51 of the lower section by approximately ½ to 1 inch. Thus, when there is an impact into gap 18, the protruding edge of upper section 12 will absorb the initial energy and flex inwardly, which provides additional protection for the user. Alternatively, this may also be accomplished by having a protruding ridge around the outside bottom periphery of upper section 12. The ridge may be approximately 1 inch high and may protrude outwardly approximately ½ to ¾ inch. Any hit to the gap area will first be contacted by the protruding ridge and will thus transfer the initial energy of the impact to upper section 12.

Helmet 10 may include an attachment method for releasably attaching a conventional known-to-the-art football neck roll to helmet 10. It will be attached to the rearward lower outside portion of lower section 14 and connected by straps, bolts, glue, hook and loop fasteners, or snaps. The width of the neck roll would be earlobe to earlobe. This feature would help stabilize the neck and head of the wearer upon impacts.

Force sensors may be added to the helmet interior to record impacts and acceleration. Examples are: ShockWatch sensors which measure G forces, manufactured by Shockwatch, Inc.; polymer sensors which can transmit impact data to the sidelines, manufactured by Sensortech Corp., for example; battery operated units which measure G forces and transmits to the sidelines, manufactured by Avnet Electronics; MEMS accelerometers manufactured by Analog Devices.

NASA developed Phase Change Material may be used to cover the foam 26 to help regulate the user's temperature. This may be made from a disposable nonwoven fabric and laminated to a perspiration-absorbent nonwoven substrate. Materials other than nonwovens may also be utilized.

Soft memory foam, or gel, or a similar compressible material, approximately ¼ inch to ½ inch thick, may be applied to the entire outside surface of the helmet 10 to improve energy dissipation. Since it may degrade after numerous impacts, it may have to be replaced every two to three games.

Coatings to the surface of upper section 12 other than polyurethane polyurea or thixotronic plastics may be considered. For example, on the outer surface of the foam a nanodeposited material such as Parylene could be applied using the normal vacuum deposition method for application of nanoparticles. The nanoparticles will impart improved surface characteristics to the foam such as impact resistance, penetration resistance, abrasion resistance, and tear resistance without adding a significant weight. Other nanoparticles besides Parylene may be utilized. The result will be a soft shell to mitigate energy transfer to the head, but with a lightweight protective outer surface to protect against fractures and lacerations. Lower section 14 could be constructed and flexibly attached to upper section 12 as previously described.

Struts 16 may be filled with non-Newtonian fluids, or similar. These fluids may be compressed within the struts 16 in their normal state to absorb energy, but will immediately harden upon impact to limit the rotation of the helmet.

From the foregoing description of the preferred, additional, and alternative embodiments of the invention, it will be apparent that many modifications may be made therein. It will be understood, however, that the embodiments of the invention are an exemplification of the invention only and that the invention is not limited thereto.

What is claimed is:

1. A protective helmet for protecting a head of a user comprising:

an exterior shell comprising an upper section and a lower section, the upper section having a lower perimeter rim and the lower section having an upper perimeter rim;

a plurality of spaced apart compression struts connecting the upper section to the lower section such that the upper perimeter rim of the lower section is spaced apart from the lower perimeter rim of the upper section, wherein the entire lower perimeter rim of the upper section is vertically spaced above the entire upper perimeter rim of the lower section;

the upper section being movable with respect to the lower section whereby at least a portion of a force from an impact to the upper section will be absorbed and will not be transmitted to the lower section.

2. The helmet as set forth in claim 1 wherein each strut has a top portion and a bottom portion; the top portion connected to the upper section and the bottom portion connected to the lower section.

3. The helmet as set forth in claim 2 wherein the struts are formed to be able to compress, flex and rotate so as to absorb an amount of energy from the impact to the upper section.

4. The helmet as set forth in claim 2 wherein each strut is made of polyvinyl chloride.

5. The helmet as set forth in claim 1 wherein each of the struts is curved thereby having a convex side and a concave side; the upper section and the lower section each having an inside surface and an outside surface; a portion of the concave side of each of the struts facing the inside surface of the upper section and the lower section.

6. The helmet as set forth in claim 1 wherein the Durometer hardness of each strut is between 40 A and 75 A, the tensile strength of each strut is between 1800 psi and 2700 psi, and the bend radius of each strut is between 1.25 inches and 4 inches.

7. The helmet as set forth in claim 1 wherein the upper section is made of a pliable material.

8. The helmet as set forth in claim 7 wherein the upper section is made from a semi-flexible polyethylene foam.

9. The helmet as set forth in claim 8 wherein an outer surface of the polyethylene foam is coated with urethane.

10. The helmet as set forth in claim 1 wherein the lower section is made from PCA or ABS plastic.

11. The helmet as set forth in claim 1 wherein the gap between the upper section and the lower section is approximately ½ inch.

12. The helmet as set forth in claim 1 wherein the upper and lower sections each have inside surfaces; a suspension harness attached to the inside surface of the lower section; the suspension harness is adapted to receive a portion of the user's head.

13. The helmet as set forth in claim 12 whereby the head of the user will be spaced from the inside surface of the upper section when the portion of the user's head is received in the harness.

14. The helmet as set forth in claim 12 wherein the harness includes a foam ring adapted to contact the user's head.

15. The helmet as set forth in claim 12 further including a plurality of resilient spacers attached to the suspension harness and contacting the inside surface of the lower section.

16. The helmet as set forth in claim 15 wherein the cross straps are attached to the resilient spacers.

17. The helmet as set forth in claim 14 further including cross straps attached to the foam ring for making contact with the top of a user's head; the cross straps extending into the inside of the upper section.

18. The helmet as set forth in claim 17 further including foam pad attached to one of the cross straps where the cross straps cross.

19. A helmet as set forth in claim 1 wherein the helmet is adapted to be releasably attached to the helmet user's shoulder pads.

20. A helmet as set forth in claim 19 further including a contoured rod attached to the rear of the lower section; a plate attached to the shoulder pads; a mechanism attached to the plate for removably attaching the plate to the contoured rod.

21. The helmet as set forth in claim 1 further including a stretchable band received about an outer periphery of the helmet within the gap.

22. A protective helmet for protecting a head of a user comprising:

an exterior shell comprising an upper section and a lower section; the upper section having a lower perimeter rim and the lower section having an upper perimeter rim;

at least one connection member connecting the upper section to the lower section such that the upper perimeter rim of the lower section is spaced apart from the lower perimeter rim of the upper section, wherein the entire lower perimeter rim of the upper section is vertically spaced above the entire upper perimeter rim of the lower section;

the upper section being movable with respect to the lower section when an impact force is applied to the outside surface of the upper section;

at least one resilient member connecting the upper section to the lower section; a portion of the force from the impact to the upper section being absorbed so that the portion of the force will not be transmitted to the lower section; and a suspension harness attached to the inside surface of the lower section; the suspension harness adapted to receive a portion of the user's head.

23. The helmet as set forth in claim 22 whereby the user's head will be spaced from the inside surface of the upper section when the portion of the user's head is received in the harness.

24. The helmet as set forth in claim 22 wherein the harness includes a foam ring adapted to contact the user's head.

25. The helmet as set forth in claim 24 further including cross straps attached to the foam ring adapted to make contact with the top of the user's head; the cross straps extending into the inside of the upper section.

26. The helmet as set forth in claim 25 further including a foam pad attached to one of the cross straps where the cross straps cross.

27. The helmet as set forth in claim 24 wherein the upper section is formed from a semi-flexible polyethylene foam.

28. The helmet as set forth in claim 22 further including a plurality of resilient spacers attached to the suspension harness and contacting the inside surface of the lower section.

29. The helmet as set forth in claim 28 wherein the cross straps are attached to the spacers.

30. The helmet as set forth in claim 22 wherein the at least one resilient member includes a plurality of spaced apart compression struts.

31. The helmet as set forth in claim 30 wherein the struts have a top portion and a bottom portion; the top portion connected to the upper section and the bottom portion connected to the lower section.

32. The helmet as set forth in claim 31 whereby the struts are formed to be able to compress, flex and rotate so as to absorb an amount of energy from the impact force to the upper section.

33. The helmet as set forth in claim 30 wherein each of the struts is curved thereby having a convex side and a concave side; the upper section and the lower section each having an inside surface and an outside surface; a portion of the concave side of each of the struts facing the inside surface of the upper section and the lower section.

34. The helmet as set forth in claim 22 wherein the upper section is made of a pliable material.

35. A helmet as set forth in claim 22 wherein the helmet is adapted to be releasably attached to the helmet user's shoulder pads.

36. A helmet as set forth in claim 35 further including a contoured rod attached to the rear of the lower section; a plate attached to the shoulder pads; a mechanism attached to the plate for removably attaching the plate to the contoured rod.

37. The helmet as set in claim 22 further including a stretchable band about the helmet and within the gap.

* * * * *